US010716979B2

(12) United States Patent
Hosooka

(10) Patent No.: US 10,716,979 B2
(45) Date of Patent: Jul. 21, 2020

(54) IRON GOLF CLUB HEAD

(71) Applicant: MIZUNO CORPORATION, Osaka (JP)

(72) Inventor: Daisuke Hosooka, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 16/365,949

(22) Filed: Mar. 27, 2019

(65) Prior Publication Data

US 2019/0299068 A1 Oct. 3, 2019

(30) Foreign Application Priority Data

Mar. 30, 2018 (JP) ..... 2018-068138

(51) Int. Cl.
*A63B 53/08* (2015.01)
*A63B 53/04* (2015.01)

(52) U.S. Cl.
CPC ..... *A63B 53/0475* (2013.01); *A63B 53/04* (2013.01); *A63B 53/047* (2013.01);
(Continued)

(58) Field of Classification Search
CPC ..... A63B 53/047; A63B 53/04; A63B 53/08; A63B 2053/0408; A63B 2053/0412;
(Continued)

(56) References Cited

U.S. PATENT DOCUMENTS 4,928,972 A * 5/1990 Nakanishi ..... A63B 53/04 473/332
2005/0096156 A1 5/2005 Chen
(Continued)

FOREIGN PATENT DOCUMENTS

JP H067487 A 1/1994
JP 2005137634 A 6/2005
(Continued)

OTHER PUBLICATIONS

Extended European Search Report issued in application No. EP19165716.2 dated Jul. 19, 2019.
(Continued)

*Primary Examiner* — Benjamin Layno
(74) *Attorney, Agent, or Firm* — Troutman Sanders LLP; James E. Schutz; Micah B. Hensley

(57) ABSTRACT

An iron golf club head includes a head member having a lace surface and a back surface located opposite to the face surface, and a badge member having an opposed surface facing the back surface and connected to the back surface and an exposed surface located opposite to the back surface the opposed surface and exposed to the outside. The badge member includes a resin plate having the opposed surface and made of a resin material, and a metal plate having the exposed surface and made of a metal material. The resin plate is provided with a plurality of recesses recessed toward the opposed surface. The plurality of recesses are arranged side by side in a toe-to-heel direction. The ratio V/S of a volume V (unit: $mm^3$) of the badge member to an area S (unit: $mm^3$) of the opposed surface is 4.0 or more and 10.0 or less.

7 Claims, 8 Drawing Sheets

(52) U.S. Cl.
CPC ..... *A63B 53/08* (2013.01); *A63B 2053/042* (2013.01); *A63B 2053/0408* (2013.01); *A63B 2053/0412* (2013.01); *A63B 2053/0416* (2013.01); *A63B 2053/0425* (2013.01); *A63B 2053/0429* (2013.01); *A63B 2053/0445* (2013.01); *A63B 2053/0454* (2013.01); *A63B 2053/0458* (2013.01); *A63B 2053/0462* (2013.01)

(58) Field of Classification Search
CPC ..... A63B 2015/0416; A63B 2053/042; A63B 2053/0425; A63B 2053/0429; A63B 2053/0454; A63B 2053/0458; A63B 2053/0462
USPC ..... 473/324, 342, 350
See application file for complete search history.

(56) References Cited

U.S. PATENT DOCUMENTS

| | | | | |
|---|---|---|---|---|
| 2008/0096687 | A1* | 4/2008 | Chen | A63B 53/047 473/342 |
| 2009/0247314 | A1* | 10/2009 | Matsunaga | A63B 53/047 473/291 |
| 2012/0172144 | A1* | 7/2012 | Mazutani | A63B 53/047 473/332 |
| 2012/0252600 | A1 | 10/2012 | Tsuji et al. | |
| 2013/0281227 | A1* | 10/2013 | Roach | A63B 53/0475 473/332 |
| 2014/0171220 | A1 | 6/2014 | Taylor et al. | |
| 2015/0273287 | A1* | 10/2015 | Doi | A63B 53/047 473/350 |
| 2018/0185716 | A1 | 7/2018 | Doi et al. | |
| 2019/0262673 | A1* | 8/2019 | Clarke | A63B 53/0475 |

FOREIGN PATENT DOCUMENTS

| | | | |
|---|---|---|---|
| JP | 2010115318 | A | 5/2010 |
| JP | 2014030588 | A | 2/2014 |
| JP | 2015181769 | A | 10/2015 |
| JP | 2017000301 | A | 1/2017 |
| JP | 6120906 | B2 | 4/2017 |
| JP | 2017176607 | A | 10/2017 |
| WO | 2012133310 | A1 | 10/2012 |
| WO | 2016199719 | A1 | 12/2016 |

OTHER PUBLICATIONS

Notice of Grounds of Rejection issued in Japanese Application No. 2018-068138 dated Feb. 25, 2020.

* cited by examiner

IRON GOLF CLUB HEAD

This non-provisional application is based on Japanese Patent Application No. 2018-068138 filed cm Mar. 30, 2018 with the Japan Patent Office, the entire contents of which are hereby incorporated by reference.

BACKGROUND OF THE INVENTION

Field of the Invention

The present invention relates to an iron golf club head.

Description of the Background Art

Japanese Patent No. 6120906 discloses a golf club head which is provided with a plate member including a resin plate and a metal plate, wherein the metal plate is disposed in such a manner that it does not overlap with a hitting point on a face portion.

Japanese Patent Laying-Open No. 2015-181769 discloses an iron golf club head which is provided with a plate member including a thick portion 16 and a thin portion 18, wherein the thick portion 16 is provided with grooves on a surface, i.e., an exposed surface opposite to the other surface connected to the face portion.

SUMMARY OF THE INVENTION

However, in the iron golf club head disclosed in Japanese Patent No. 6120906, not only the metal plate but also the resin plate are exposed to the outside. In order to achieve an iron golf club head with excellent aesthetic appearance, it is required to reduce the amount of the resin plate to be exposed and increase the amount of the metal plate to be exposed than the iron golf club head mentioned above. In addition, when an iron golf club head is provided with a sufficiently bulky member attached to the back surface of a head member, it is possible for it to offer a comfortable hit feeling to advanced players. However, the member attached to the iron golf club head disclosed in Japanese Patent Laying-Open No. 2015-181769 is not sufficiently bulky.

The main objective of the present invention is to provide an iron golf club head with a sufficiently bulky badge member attached to a back surface of a head member in such a manner that the badge member is hard to detach from the head member, making the iron golf club head excellent in aesthetic appearance, and an iron golf club including the ion golf club head.

The iron golf club head according to the present invention includes a head member having a hitting surface and a back surface located opposite to the hitting surface, and a badge member having an opposed surface facing the back surface and connected to the back surface and an exposed surface located opposite to the opposed surface and exposed to the outside. The badge member includes a resin plate having the opposed surface and made of a resin material and a metal plate having the exposed surface and made of a metal material. The resin plate is provided with a plurality of recesses recessed toward the opposed surface. The plurality of recesses are arranged side by side in a first direction from a heel of the iron golf club head to a toe thereof. The width of each of the plurality of recesses in the first direction is smaller than the width of each of the plurality of recesses in a second direction from a top edge of the iron golf club head to a leading edge thereof A ratio V/S of a volume V (unit: $mm^3$) of the badge member to an area S (unit: $mm^2$) of the opposed surface is 4.0 or more and 10.0 or less.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 14F is a side view illustrating a plate member of sample 6 according to the example.

DESCRIPTION OF THE PREFERRED EMBODIMENTS

Figure 1:
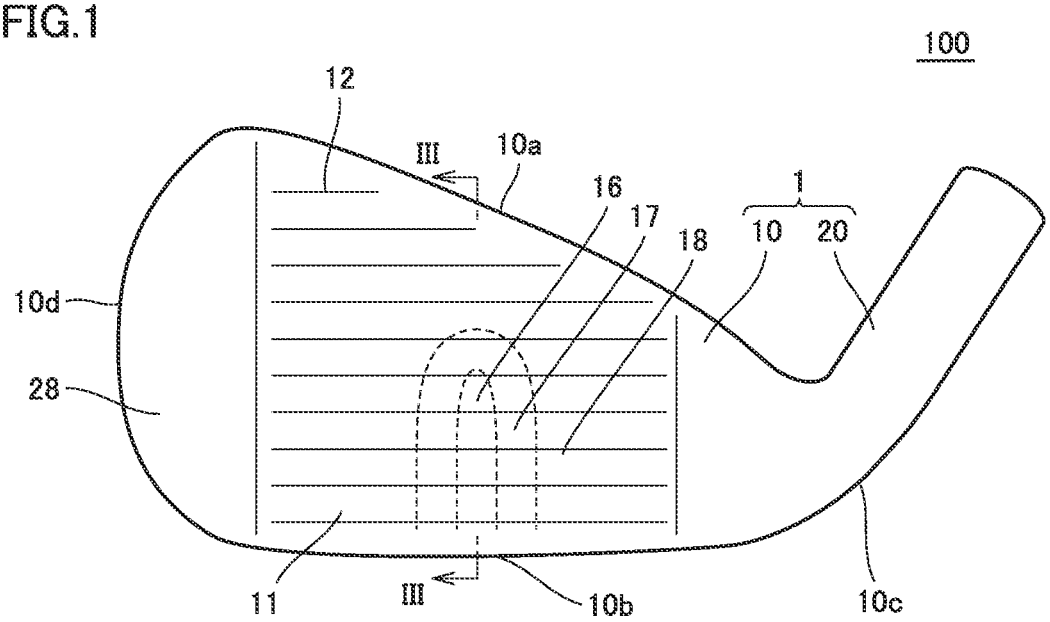
FIG. 1 is a front view of an iron golf club head according to the present embodiment.

Hereinafter, an embodiment of the present invention will be described with reference to the drawings. In the following drawings, the same or corresponding parts will be denoted by the same reference numerals, and the description thereof will not be repeated.

(Embodiment) <Configuration of Iron Golf Club Head>

As illustrated in FIGS. 1 to 12, an iron golf club head 100 according to the present embodiment includes a head member 1, a badge member 2, and an adhesive member 3.

Figure 2:
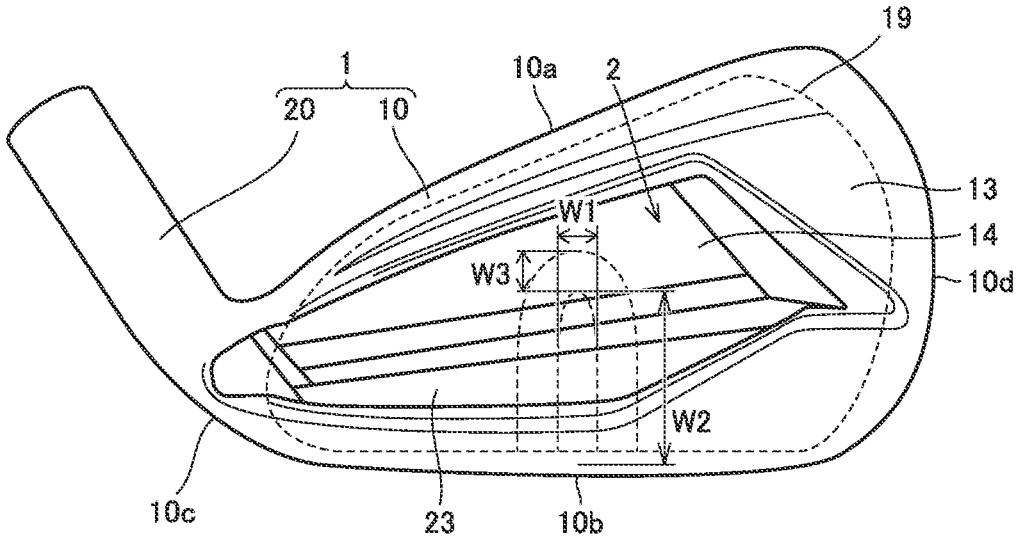
FIG. 2 is a rear view of the iron golf club head according to the present embodiment.
Figure 3:
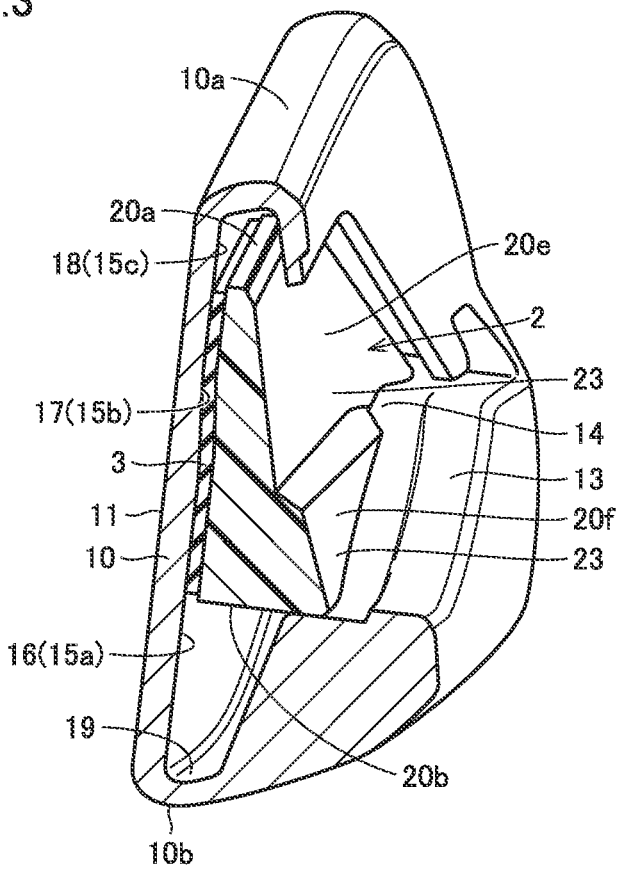
FIG. 3 is a cross-sectional perspective view of the iron golf club head cut along a line III-III in FIG. 1 that passes through a score centerline and is perpendicular to score lines.

As illustrated in FIGS. 1 to 3, to the head member 1 includes a main body 10 and a hosel 20. The main body 10 includes a top edge 10*a*, a leading edge 10*b*, a heel 10*c*, a toe 10*d*, a face surface 11, grooves 12, a margin 13, a cavity 14, and a back surface 15.

The top edge 10*a* constitutes an upper end of the main body 10 when the iron golf club head 100 is placed on a horizontal surface at a predefined loft angle and a predefined lie angle (hereinafter referred to as "reference position"). The leading edge 10*b* constitutes a front end of the main body 10 when the iron golf club head 100 is placed at the reference position. The term of front or back in the main body 10 refers to the front side or back side in the moving direction of the iron golf club head 100 when it is swung. The heel 10*c* is configured to join a lower end of the hosel 20 and the leading edge 10*b*. The toe 10*d* is located opposite to the heel 10*c*, and is configured to join the top edge 10*a* and the leading edge 10*b*. The distance between the top edge 10*a* and the leading edge 10*b* is smaller than the distance between the heel 10*c* and the toe 10*d*.

The face surface 11 is a hitting face. The face surface 11 is surrounded by the top edge 10*a*, the leading edge 10*b*, the heel 10*c* and the toe 10*d*. The face surface 11 is provided with a plurality of grooves (score lines) 12. Each of the plurality of grooves 12 extends linearly in the horizontal direction when the iron golf club head 100 is placed at the reference position. The plurality of grooves 12 are spaced apart from one another in the vertical direction (second direction) when the iron golf club head 100 is placed at the reference position.

As illustrated in FIGS. 2 and 3, the margin 13, the cavity 14 and the back surface 15 are formed on the back side of the face surface 11. The back surface 15 is located opposite to the face surface 11. The margin 13 circumferentially surrounds the back surface 15. The cavity 14 is surrounded by the margin 13, and the bottom surface of the cavity 14 is the back surface 15. The margin 13 is provided with an undercut 19. The undercut 19 is disposed as a groove along the outer edge of the back surface 15.

As illustrated in FIGS. 1 to 3 and FIG. 7, the head member 1 includes, for example, a thick portion 16 that is relatively thick in a direction perpendicular to the face surface 11, a thin portion 18 that is thinner than the thick portion 16, and a taper portion 17 that is connected between the thick portion 16 and the thin portion 18 with a gradually varying thickness. The thick portion 16 is provided, for example, at a substantially central position in the toe-to-heel direction (first direction) from the heel 10*c* of the head member 1 toward the toe 10*d* thereof. The thin portion 18 is provided around the thick portion 16. The taper portion 17 is provided between the thick portion 16 and the thin portion 18. The back surface 15 includes a first top surface 15*a* included in the thick portion 16, a first bottom surface 15*c* included in the thin portion 18, and a first inclined surface 15*b* included in the taper portion 17 and inclined relative to the first top surface 15*a* and the first bottom surface 15*c*.

The first top surface 15*a* protrudes 0.25 mm or more and 1.50 mm or less relative to the first bottom surface 15*c* in the direction perpendicular to the face surface 11. The thickness of the thin portion 18 is, for example, 18 mm or more and 3.0 mm or less.

The center of the thick portion 16 and the first top surface 15*a* in the toe-to-heel direction lies at a score centerline of the face surface 11 in the direction perpendicular to the face surface 11. The thick portion 16 and the first top surface 15*a* are connected to the leading edge 10*b*. The thin portion 18 is provided around the thick portion 16. The taper portion 17 is provided between the thick portion 16 and the thin portion 18 The first bottom surface 15*c* is provided around the first top surface 15*a*. The first inclined surface 15*b* is provided between the first top surface 15*a* and the first bottom surface 15*c*. The maximum width W1 of the first top surface 15*a* in the toe-to-heel direction is, for example, 3.1 mm or more and 4.7 mm or less, and preferably 3.5 mm or more and 4.3 mm or less. The maximum width W2 of he first top surface 15*a* in the second direction is, for example, 18.3 mm or more and 27.5 mm or less, and preferably 20.6 mm or more and 25.2 mm or less. The maximum width W3 of the first inclined surface 15*b* in the second direction is, for example, 5.2 mm or more and 7.8 mm or less, and preferably 5.8 mm or more and 7.2 mm or less.

The material constituting the head member 1 includes, for example, titanium (Ti), maraging steel, chromium molybdenum steel, stainless steel or carbon steel.

As illustrated in FIGS. 2 and 3, the badge member 2 is fixed to the back surface 15 of the head member 1. The badge member 2 is accommodated in the cavity 14 of the head member 1. The outer edge of the badge member 2 is surrounded by the margin 13.

Figure 4:
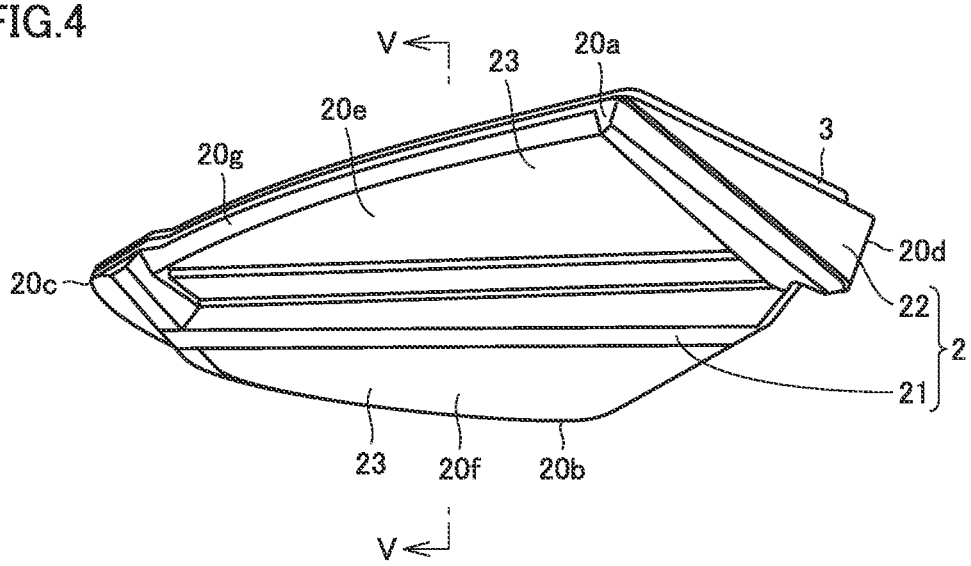
FIG. 4 is a view of a plate member according to the present embodiment when viewed from the back side of the iron golf club head.

As illustrated in FIGS. 3 and 4, the badge member 2 includes an upper edge 20*a*, a lower edge 20*b*, a heel-side edge 20*c*, a toe-side edge 20*d*, an exposed surface 23, and an opposed surface 24. The upper edge 20*a* is provided closer to the top edge 10*a*. The lower edge 20*b* is provided closer to the leading edge 10*b*. The heel-side edge 20*c* is provided closer to the heel 10*c*. The toe-side edge part 20*d* is provided closer to the toe 10*d*. The exposed surface 23 and the opposed surface 24 are surrounded by the upper edge 20*a*, the lower edge 20*b*, the heel-side edge 20*c* and the toe-side edge 20*d*.

As illustrated in FIG. 3, the opposed surface 24 faces the back surface 15 of the head member 1, and is bonded to the back surface 15 via the adhesive member 3. The exposed surface 23 is located opposite to the opposed surface 24, and is a visible surface when the iron golf club head 100 is viewed from the rear side. The upper edge 20*a*, the lower edge 20*b*, the heel-side edge 20*c* and the toe-side edge 20*d* of the badge 2 are surrounded by the margin 13 of the head member 1. The lower edge 20*b* of the badge member 2 is filled in, for example, the undercut 19 of the head member 1. The rear portion of the lower edge 20*b* is connected to, for example, the margin 13.

As illustrated in FIG. 4, the distance between the heel-side edge 20*c* and the toe-side edge 20*d* of the badge 2 is greater than the distance between the upper edge 20*a* and the lower edge 20*b* of the badge 2. The distance between the upper edge 20*a* and the lower edge 20*b* of the badge member 2 is equal to or greater than, for example, the maximum thickness of the badge member 2, in other words, the maximum distance between the exposed surface 23 and the opposed surface 24.

Figure 5:
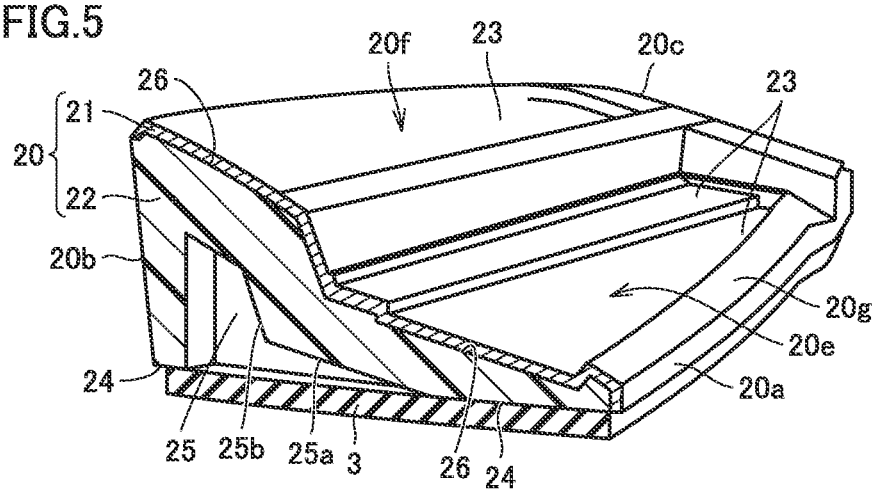
FIG. 5 is a cross-sectional perspective view of the plate member according to the present embodiment.

As illustrated in FIGS. 3 to 5, the badge member 2 includes a first portion 20*e* that is relatively thin and a second portion 20*f* that is thicker than the first portion 20*e*. The first portion 20*e* and the second portion 20*f* are aligned in the vertical direction. When the iron golf club head 100 is placed at the reference position, the first portion 20*e* is disposed above the second portion 20*f*. The first portion 20*e* has the upper edge 20*a*. The second portion 20*f* has the lower edge 20*b*. The thickness of the first portion 20*e* and the second portion 20*f* gradually increases from the upper edge 20*a* toward the lower edge 20*b*. The boundary between the first portion 20*e* and the second portion 20*f* extends between the heel-side edge 20*c* and the toe-side edge 20*d* in the toe-to-heel direction.

Figure 6:
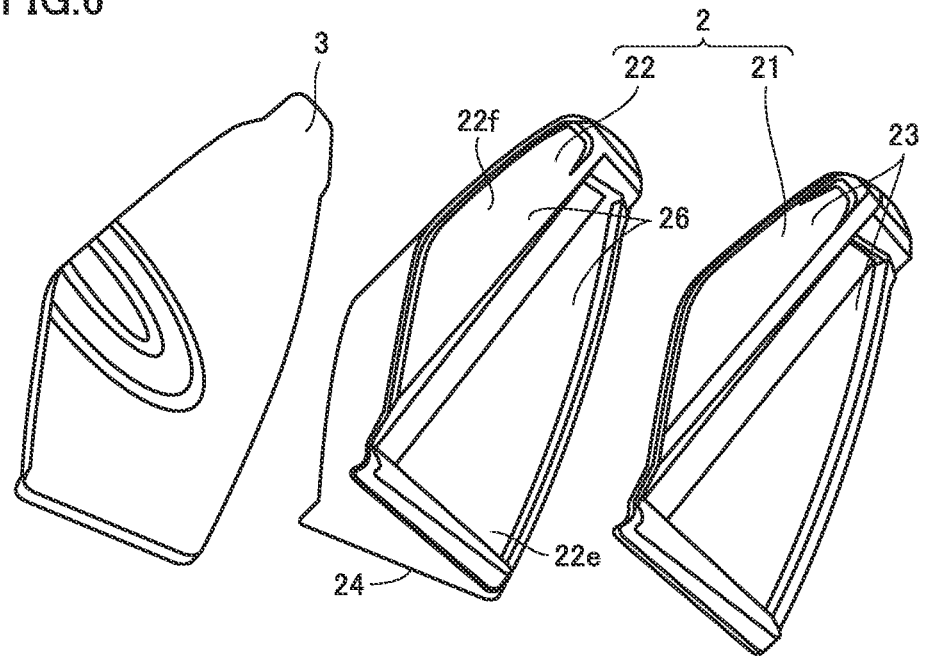
FIG. 6 is an exploded perspective view of the plate member according to the present embodiment.
Figure 7:
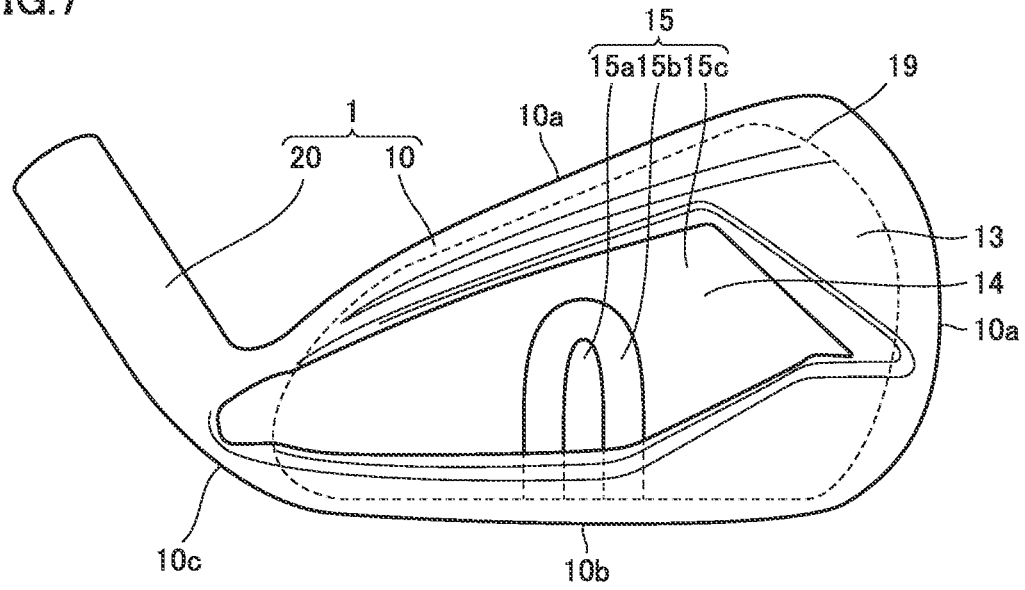
FIG. 7 is a rear view of a head member according to the present embodiment.

As illustrated in FIGS. 4 to 6, the badge member 2 includes a metal plate 21 and a resin plate 22. The metal plate 21 and the resin plate 22 are stacked in the direction perpendicular to the face surface 11. The metal plate 21 is disposed behind the resin plate 22 and has the exposed surface 23. The exposed surface 23 is constituted only by the metal plate 21. The resin plate 22 has the opposed surface 24 and does not have the exposed surface 23. A first bonding surface located opposite to the exposed surface 23 of the metal plate 21 and a second bonding surface 26 located opposite to the opposed surface 24 of the resin plate 22 are bonded together. Each of the first portion 20*e* and the second portion 20*f* has a structure in which the metal plate 21 and the resin plate 22 are stacked.

As illustrated in FIG. 5, the average distance between the first bonding surface and the exposed surface 23 of the metal plate 21 is smaller than the average distance between the second bonding surface 26 and the opposed surface 24 of the resin plate 22. The distance between the first bonding surface of the metal plate 21 and the exposed surface 23 is substantially constant.

As illustrated in FIGS. 5 and 6, the resin plate 22 includes a third portion 22*e* that is relatively thin and a fourth portion 22*f* that is thicker than the third portion 22*c*. The third portion 22*c* and the fourth portion 22*f* are aligned in the vertical direction When the iron golf club head 100 is placed at the reference position, the third portion 22*e* is disposed above the fourth portion 22*f*. The distance between the second bonding surface 26 and the opposed surface 24 of the resin plate 22 gradually increases from the upper edge 20*a* toward the lower edge 20*b*. The distance between the second bonding surface 26 and the opposed surface 24 of the resin plate 22 gradually decreases from a central position in the toe-to-heel direction toward the heel-side edge 20*c*. The thickness distribution of the first portion 20*e* and the second portion 20*f* of the badge member 2 is determined by the thickness distribution of the third portion 22*c* and the fourth portion 22*f* of the resin plate 22.

As illustrated in FIGS. 5 and 8 to 11, the resin plate 22 is provided with a plurality of recesses 25 recessed toward the opposed surface 24. The plurality of recesses 25 may be provided at least in a central position in the toe-to-heel direction, but it is preferable that the plurality of recesses 25 are also disposed closer to the heel 10*c* than the central position in the toe-to-heel direction and closer to the toe 10*d* than the central position in the toe-to-heel direction. The plurality of recesses 25 are spaced apart from one another in the toe-to-heel direction. The opposed surface 24 separating two recesses 25 adjacent in the toe-to-heel direction extends along a direction intersecting the toe-to-heel direction.

The plurality of recesses 25 are divided into 3 groups, i.e., a first group of recesses 25 provided in a substantially central position of the head member 1 in the toe-to-heel direction, a second group of recesses 25 provided closer to the heel 10*c* than the central position in the toe-to-heel direction, and a third group of recesses 25 provided closer to the toe 10*d* than the central position in the toe-to-heel direction. The first group of recesses 25 face the first top surface 15*a*, the first inclined surface 15*b* and the first bottom surface 15*c* of the head member 1 in the direction perpendicular to the face surface 11. The second group of recesses 25 and the third group of recesses 25 face the first bottom surface 15*c* of the head member 1 in the direction perpendicular to the face surface 11.

The plurality of recesses 25 are provided at least in the second portion 20*f*. The plurality of recesses 25 are provided in, for example, the first portion 20*e* and the second portion 20*f*. For example, a part of each recess 25 is located in the second portion 20*f*, and the left part of each recess 25 is located in the first portion 20*e* closer to the second portion 20*f*. The end of each recess 25 closer to the upper edge 20*a* is arranged, for example, along the extending direction of the upper edge 20*a*. The end of each recess 25 closer to the lower edge 20*b* is arranged, for example, along the extending direction of the lower edge 20*b*. In each recess 25, the depth of the part in the first portion 20*e* relative to the opposed surface 24 is shallower than the depth of the part in the second portion 20*f* relative to the opposed surface 24.

As illustrated in FIG. 5, the depth of each recess 25 relative to the opposed surface 24 gradually increases, for example, from the upper edge 20*a* toward the lower edge 20*b*. In each recess 25, the deepest part having the deepest depth relative to the opposed surface 24 is located closest to the lower edge 20*b*.

As illustrated in FIG. 5, at least a part of the plurality of recesses 25 each includes, for example, a surface 25*a* inclined relative to the opposed surface 24 at a first inclination angle, and a surface 25*b* connected to an end of the surface 25*a* closer to the lower edge 20*b* and inclined relative to the opposed surface 24 at a second inclination angle greater than the first inclination angle. In such a recess 25, the surface 25*a* and the surface 25*b* share a common side. The common side of each recess 25 extends along the toe-to-heel direction.

Figure 8:
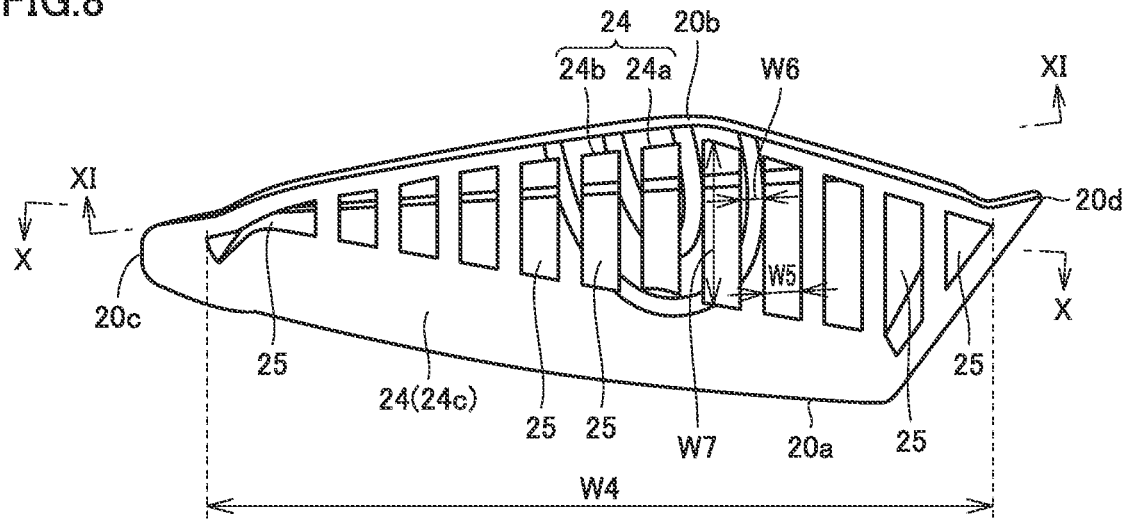
FIG. 8 is a view of the plate member according to the present embodiment when viewed from the front side of the iron golf club head.

As illustrated in FIG. 8, the opposed surface 24 includes a second bottom surface 24*a* facing the first top surface 15*a*, a second top surface 24*c* facing the first bottom surface 15*c*, and a second inclined surface 24*b* facing the first inclined surface 15*b* and inclined relative to the second bottom surface 24*a* and the second top surface 24*c*.

The second bottom surface 24*a* overlaps with the score centerline of the face surface 11 in the direction perpendicular to the face surface 11. The second bottom surface 24*a* is connected to the lower edge 20*b* The second top surface 24*c* is provided around the thick portion 16. The second inclined surface 24*b* is provided between the second bottom surface 24*a* and the second top surface 24*c*. The first top surface 15*a* and the second bottom surface 24*a* are parallel to each other, for example The first inclined surface 15*b* and the second inclined surface 24*b* are parallel to each other, for example. The first bottom surface 15*c* and the second lop surface 24*c* are parallel to each other, for example. The distance between the first top surface 15*a* and the second bottom surface 24*a*, the distance between the first inclined surface 15*b* and the second inclined surface 24*b*, and the distance between the first bottom surface 15*c* and the second top surface 24*c* arc equal to each other, for example. The second top surface 24*c* protrudes 0.25 mm or more and 1.50 mm or less relative to the second bottom surface 24*a* in the direction perpendicular to the face surface 11.

As illustrated in FIG. 8, regarding the plurality of recesses 25 provided between two recesses 25 located at both ends in the toe-to-heel direction, the width of each recess 25 in the direction from the upper edge 20*a* toward the lower edge 20*b* is greater than the width thereof in the toe-to-heel direction. The width in the toe-to-heel direction of each of the two recesses 25 located at both ends in the toe-to-heel direction is greater than, for example, the width in the toe-to-heel direction of each of the plurality of recess 25 located between the two recesses 25. The distance in the toe-to-heel direction between two adjacent recesses 25 is smaller than the width in the toe-to-heel direction of each recess 25 provided between the two recesses 25. For example, the width W5 in the toe-to-heel direction of each recess 25 provided between the two recesses 25 is constant, and may be 2 mm or more and 4 mm or less, for example. For example, the distance W6 in the toe-to-heel direction between two adjacent recesses 25 is constant, and may be 1 mm or more and 3 mm or less, for example. Among the plurality of recesses 25, a recess 25 located substantially at the central position in the toe-to-heel direction has the maximum width W7 in the direction from the upper edge 20*a* to the lower edge 20*b*, and the maximum width W7 may be, for example, 12 mm or more and 15 mm or less. The distance W4 between one end and the other end of the plurality of recesses 25 in the toe-to-heel direction is greater than the maximum width W7 of the plurality of recesses 25, and may be, for example, 52 mm or more and 78 mm or less.

Figure 9:
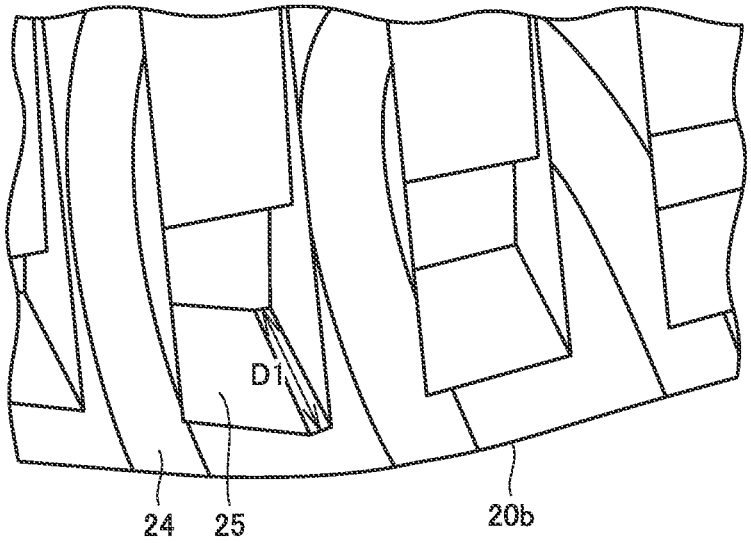
FIG. 9 is a partially enlarged view of a recess on the plate member in FIG. 8 according to the present embodiment.

As illustrated in FIGS. 8 and 9, among the plurality of recesses 25, a recess 25 located substantially at the central position in the toe-to-heel direction has the maximum depth D1, and the maximum depth D1 of the deepest part may be, for example, 4.3 mm or more and 8.3 mm or less. The recess 25 having the maximum depth D1 is, for example, the same as the recess 25 having the maximum width W7.

As illustrated in FIG. 8, the number of recesses 25 that are provided is 12. for example. The recess 25 having the maximum width W7 is, for example, the fifth one when counted from the recess 25 located closest to the toe in the toe-to-heel direction.

As illustrated in FIG. 8, the width of each recess 25 in the toe-to-heel direction is, for example, equal to or less than the width of the first lop surface 15*a* of the head member 1 in the toe-to-heel direction, and is, for example, less than the width of the first top surface 15*a* in the toe-to-heel direction. The width of each recess 25 in the toe-to-heel direction is, for example, equal to or less than the width of the second bottom surface 24*a* in the toe-to-heel direction, and is, for example, less than the width of the second bottom surface 24*a* in the toe-to-heel direction.

As illustrated in FIGS. 4 and 5, the badge member 2 may further include a peripheral edge 20*g* that surrounds the first portion 20*e* and the second portion 20*f* in a planar view of the exposed surface 23. The thickness of the peripheral edge 20*g* is greater than the thickness of the first portion 20*e* adjacent to the peripheral edge 20*g* and smaller than the thickness of the second portion 20*f*.

Figure 10:
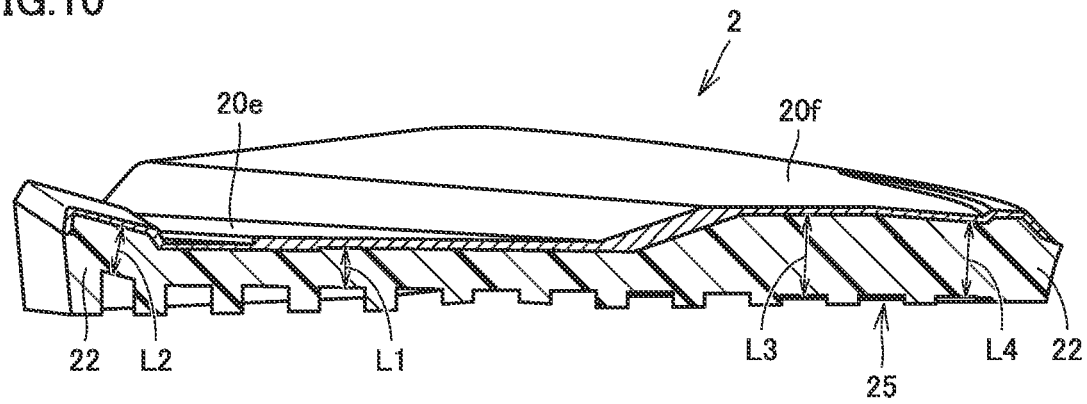
FIG. 10 is a cross-sectional perspective view of the plate member cut along a line XX in FIG. 8 in a direction intersecting a toe-to-heel direction.

As illustrated in FIG. 10, in the cross section taken along the direction intersecting the toe-to-heel direction, the minimum distance between the bottom of each recess 25 formed in the first portion 20*e* and the exposed surface 23, the minimum distance between the bottom of each recess 25 formed in the second portion 20*f* and the exposed surface 23, and the minimum distance between the bottom of each recess 25 formed in the peripheral edge 20*g* and the exposed surface 23 are different, for example. The minimum distance L1 between the bottom of the recess 25 formed in the first portion 20*e* and the exposed surface 23 is smaller than the minimum distance L2 between the bottom of the recess 25 formed in the peripheral edge 20*g* and the exposed surface 23. The minimum distance L3 or L4 between the bottom of the recess 25 formed in the second portion 20*f* and the exposed surface 23 is greater than the minimum distance L1 or L2. In the second portion 20*f*, the minimum distance L4 between the bottom of a recess 25 formed closer to the heel 10*c* and the exposed surface 23 is smaller than the minimum distance L3 between the bottom of a recess 25 formed closer to the central position of the badge member 2 and the exposed surface 23.

Figure 11:
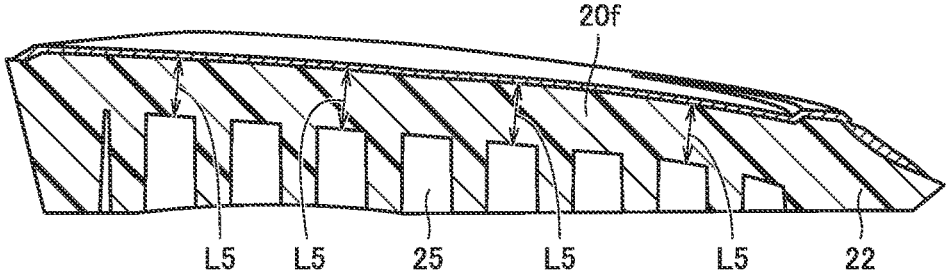
FIG. 11 is a cross-sectional perspective view of the plate member cut along a line XI-XI in FIG. 8 in the toe-to-heel direction.

As illustrated in FIG. 11, in the cross section taken along the toe-to-heel direction, the minimum distance L5 between the bottom of each recess 25 formed in the second portion 20*f* and the exposed surface 23 is equal, for example. The minimum distance L5 is greater than the minimum distances L1 and L2. The minimum distance L5 is smaller than, for example, the minimum distances L3 and L4.

Figure 12:
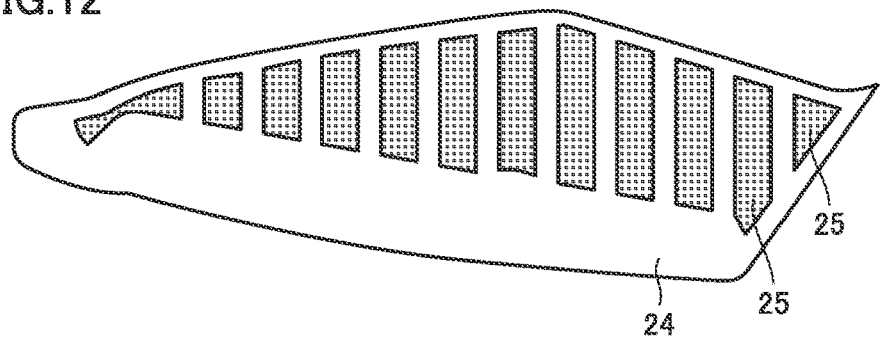
FIG. 12 is a diagram for explaining the area of an opposed surface of the plate member according to the present embodiment.

As illustrated in FIG. 12, in a planar view of the opposed surface 24, the ratio of the area occupied by the plurality of recesses 25 to the total area surrounded by the outline of the badge member 2 is, for example, 20% or more and 40% or less. In other words, in a planar view of the opposed surface 24, the ratio of the area of the opposed surface 24 to the total area surrounded by the outline of the badge member 2 is, for example, 60% or more and 80% or less.

The material constituting the metal plate 21 may be any metal material that is relatively bendable, and may include aluminum (Al), for example. The metal plate 21 may be formed by any method such as electroforming. The material constituting the resin plate 22 includes a thermosetting elastomer or a thermoplastic elastomer. The thermosetting elastomer may be natural rubber or synthetic rubber such as urethane rubber. Thermoplastic elastomer may include polyurethane-based thermoplastic elastomer (TPU), styrene-based thermoplastic elastomer (TPS), or olefin-based thermoplastic elastomer (TPO). The resin plate 22 is less rigid than epoxy resin or ABS (Acrylonitrile Butadiene Stvrene) resin The resin plate 22 may be formed by any method for example, the resin plate 22 may be formed by filling a resin in a mold in which the metal plate 21 previously formed by electroforming is disposed.

The adhesive member 3 may be a double-sided adhesive tape. The adhesive member 3 has a first adhesive surface bonded to the back surface 15 of the head member 1 and a second adhesive surface located opposite to the first adhesive surface and bonded to the opposed surface 24 of the badge member 2. The first adhesive surface of the adhesive member 3 is bonded to the first top surface 15*a*, the first inclined surface 15*b* and the first bottom surface 15*c* of the back surface 15. The second adhesive surface of the adhesive member 3 is bonded to the second bottom surface 24*a*, the second inclined surface 24*b* and the second top surface 24*c* of the opposed surface 24.

The adhesive member 3 may be any member as long as it has an appropriate thickness and an appropriate adhesive force. In the iron golf club head 100, the ratio V/S of the volume V (unit: $mm^3$) of the badge member 2 to the area S (unit: $mm^2$) of the opposed surface 24 is 4.0 or more and 10.0 or less. The area S of the opposed surface 24 represents the total area of the second bottom surface 24*a*, the second top surface 24*c* and the second inclined surface 24*b*, and does not include the inner peripheral area of the plurality of recesses 25. The volume V of the badge member 2 represents the volume of a region surrounded by the outer circumfercntial surface of the badge member 2 including the exposed surface 23 and the opposed surface 24, and does not include the volume of the plurality of recesses 25. The volume V may be measured by immersing the badge member 2 in water, for example. As described above, the ratio V/S represents a distance corresponding to the average thickness of the badge member 2. As the ratio V/S increases, the average thickness of the badge member 2 becomes greater.

The coefficient of restitution COR of the head member 1 is preferably 0.82 or more. Hereinafter, a method of measuring the coefficient of restitution will be described. Under a condition where the face surface 11 of the iron golf club head 100 is placed perpendicular to the ground and a testing golf ball, a speed measurer equipped with an optical sensor is used to measure a speed (Vm) of the golf ball before it comes into collision with the central position or a sweet spot of the score lines and a speed ($V_{out}$) of the golf ball after the collision. The speed $V_{in}$ is 40.5±0.5 m/s The coefficient of restitution COR may be calculated from the measured $V_{in}$ and $V_{out}$, the mass M of the iron golf club head 100, and the mass in of the golf ball according to the following equation (1).

$$V_{out}/V_{in}(eM-m)/(M\cdot m) \quad (1)$$

<Structure of Iron Golf Club>

Figure 13:
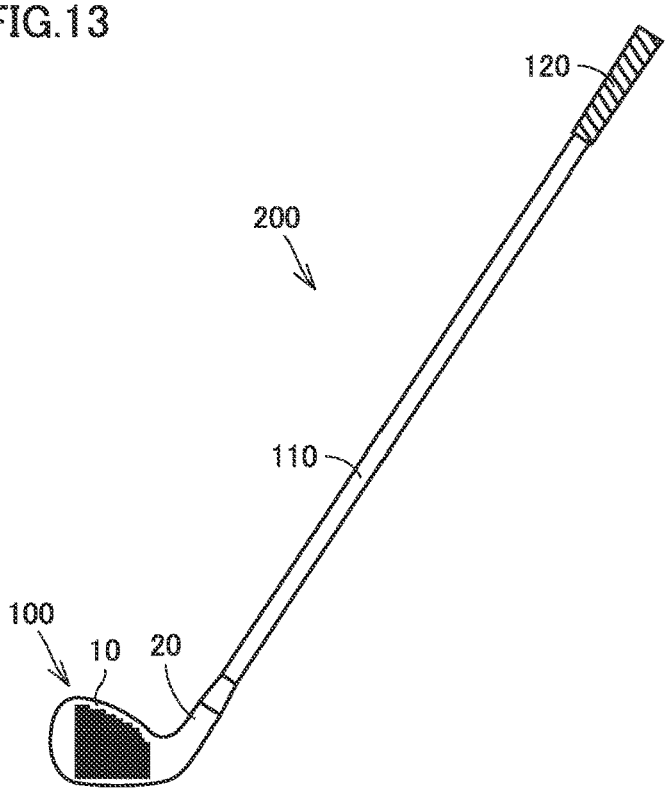
FIG. 13 is a front view of an iron golf club according to the present embodiment.
Figure 14A:
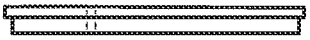
FIG. 14A is a side view illustrating a plate member of sample 1 according to an example.
Figure 14B:
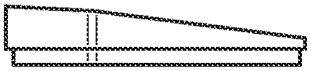
FIG. 14B is a side view illustrating a plate member of sample 2 according to the example.
Figure 14C:
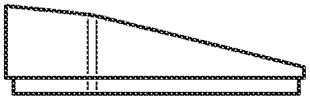
FIG. 14C is a side view illustrating a plate member of sample 3 according to the example.
Figure 14D:
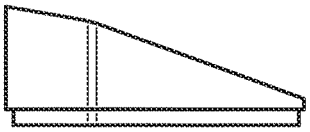
FIG. 14D is a side view illustrating a plate member of sample 4 according to the example.
Figure 14E:
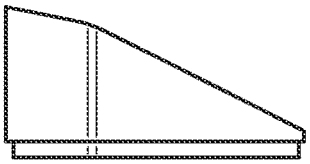
FIG. 14F is a side view illustrating a plate member of sample 5 according to the example.
Figure 14F:
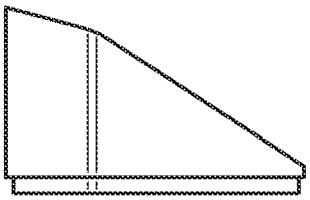

As illustrated in FIG. 13, the iron golf club 200 includes the iron golf club head 100, a shaft 110 and a grip 120. The shaft 110 has one end and the other end. The iron golf club head 100 is attached to one end of the shaft 110, and the grip 120 is attached to the other end of the shaft 110.

<Effects>

The iron golf club head 100 includes a head member 1 having a face surface 11 and a back surface 15 located opposite to the face surface 11, and a badge member 2 having an opposed surface 24 facing the back surface 15 and connected to the back surface 15, and an exposed surface 23 located opposite to the opposed surface 24 and exposed to the outside. The badge member 2 includes a resin plate 22 having the opposed surface 24 and made of a resin material, and a metal plate 21 having the exposed surface 23 and made of a metal material. The resin plate 22 is provided with a plurality of recesses 25 recessed toward the opposed surface 24. The plurality of recesses 25 are arranged side by side in the toe-to-heel direction. The ratio V/S of the volume V (unit: $mm^3$) of the badge member 2 to the area S (unit: $mm^2$) of the opposed surface 24 is 4.0 or more and 10.0 or less.

Since the ratio V/S of the iron golf club head 100 is 4.0 or more, it is possible for it to offer a comfortable hit feeling to advanced players. In addition, the results of an organoleptic evaluation test on the relationship between the ratio V/S and the voluminous feeling offered to a golfer will be shown in the example to be described later.

When the ratio V/S is more than 10.0, in order to accommodate the badge member, the cavity 14 is required to be made larger, which deteriorates the aesthetic appearance of the iron golf club head 100 Since the ratio V/S of the iron golf club head 100 is 10.0 or less, the aesthetic appearance thereof will not be deteriorated by the badge member 2.

Furthermore, in the iron golf club head 100, the badge member 2 includes the metal plate 21, and the metal plate 21 includes the exposed surface 23 of the badge member 2. Therefore, the aesthetic appearance of the iron golf club head 100 is better than the aesthetic appearance when the resin plate 22 includes the exposed surface 23.

Compared with a badge member having the ratio V/S of 4.0 or more but not including the metal plate 21, the badge member 2 having the ratio V/S of 4.0 or more and including the metal plate 21 is more rigid and hard to bend. In particular, in the main body 10 of the iron golf club head 100, since the distance between the heel 10*c* and the toe 10*d* is longer than the distance between the top edge 10*a* and the leading edge 10*b*, the deflection length in the toe-to-heel direction is longer than the deflection length in the vertical direction when hitting a ball. Therefore, if the badge member 2 is hard to bend in the toe-to-heel direction, the badge member 2 may not follow the bending of the head member 1 at the time of hitting a ball, which makes it easy for the badge member 2 to detach from the head member 1.

On the other hand, even though the badge member 2 has the ratio V/S of 4.0 or more and includes the metal plate 21, since the resin plate 22 is provided with the plurality of recesses 25 arranged side by side in the toe-to-heel direction, it is easy for the badge member 2 to bend in the toe-to-heel direction. Therefore, in the iron golf club head 100, it is possible for the badge member 2 to follow the bending of the head member 1, which makes it difficult for the badge member 2 to detach from the head member 1. In addition, the simulation result on the deflection in the toe-to-heel direction between the badge member 2 which is provided with a plurality of recesses 25 and a badge member which is not provided with a plurality of recesses 25 will be shown in the example to be describer later Furthermore, the test result on the detachment of the badge member 2 of the iron golf club head 100 will also be shown in the example to be describer later.

According to the iron golf club head 100, the badge member 2 includes a first portion 20*e* located closer to the top edge 10*a* and a second portion 20*f* located closer to the leading edge 10*b* than the first portion 20*e*. The thickness of the first portion 20*e* is smaller than the thickness of the second portion 20*f*.

According to the iron golf club head 100, the head member 1 includes a thick portion 16 provided at a substantially central position in the toe-to-heel direction, a thin portion 18 provided around the thick portion 16, and a taper portion 17 provided between the thick portion 16 and the thin portion 18. The back surface 15 includes a first top surface 15*a* included in the thick portion 16, a first bottom surface 15*c* included in the thin portion 18, and a first inclined surface 15*b* included in the taper portion 17 and inclined relative to the first top surface 15*a* and the first bottom surface 15*c*. The opposed surface 24 includes a second bottom surface 24*a* facing the first top surface 15*a*, a second top surface 24*c* facing the first bottom surface 15*c*, and a second inclined surface 24*b* facing the first inclined surface 15*b* and inclined relative to the second bottom surface 24*a* and the second top surface 24*c*.

Thus, the head member 1 includes the thick portion 16, the thin portion 18 and the taper portion 17, and the first top surface 15*a* of the thick portion 16 is connected to the first bottom surface 15*c* of the thin portion 18 with the thickness changed continuously. Therefore, compared with an iron golf club head having the thick portion 16 and the thin portion 18 but not having a taper portion, the iron golf club head 100 could prevent the stress from being concentrated on the connection portion between the thick portion 16 and the thin portion 18. As a result, even though the difference between the thickness of the thick portion 16 and the thickness of the thin portion 18 is small, it is possible to improve the durability of the iron golf club head 100.

In addition, since the durability of the iron golf club head 100 is improved by providing a taper portion in the head member 1, the thickness of the thick portion 16 may be reduced, which enables the iron golf club head 100 to have high rebound performance at the sweet spot further, compared with an iron golf club head provided with the thick portion 16 and the thin portion 18 but without a taper portion, it is possible to reduce the weight of the iron golf club head 100.

Since the iron golf club head 100 is provided with a taper portion, compared with an iron golf club head provided with a thick portion 16 and a thin portion 18 but without a taper portion, it is possible for it to reduce the difference between the flying distance of a golf ball when it is hit at the sweet spot and the flying distance of the golf ball when it is hit at the periphery of the sweet spot.

In the iron golf club head 100, the coefficient of restitution COR of the head member 1 is preferably 0.82 or more. Even though the head member 1 has high rebound performance, since the badge member 2 is designed to easily bend in the toe-to-heel direction, it is difficult for it to detach from the head member 1 when hitting a ball. Therefore, the iron golf club head 100 can achieve the above-described effects and has high hitting performance.

The iron golf club 200 includes the iron golf club head 100. As a result, the iron golf club 200 is sufficiently bulky at the central position of the back surface of the head member while having a perfect aesthetic appearance.

EXAMPLE

The present inventors carried out the following experiments to attain the iron golf club head according to the present invention.

<Experiment 1: Voluminous feeling of the Badge Member Sought by a Golfer>

In this experiment, the voluminous feeling sensed by a golfer from the badge member was tested according to organoleptic evaluation.

First, six head members with the same configuration and six badge members with different ratio V/S ranging from 1.0 or more and 6.0 or less were prepared (FIGS. 14A to 14F). Six iron golf club heads of samples 1 to 6 were prepared by fixing a badge member to the cavity of a head member. The ratio V/S of sample 1 was 1.0, the ratio V/S of sample 2 was 2.0, the ratio V/S of sample 3 was 3.0, the ratio V/S of sample 4 was 4.0, the ratio V/S of the sample 5 was 5.0, and the ratio V/S of the sample 6 was 6.0.

Next, whether or not a golfer who visually viewed the iron golf club head of samples 1 to 6 will have a voluminous feeling for each of the badge members of samples 1 to 6 was evaluated. 7 golfers were selected as the subjects for the evaluation. Table 1 shows the evaluation results. Table 1 shows the minimum ratio V/S for the sample to which each subject had a voluminous feeling.

TABLE 1

| | The minimum ratio V/S when the voluminous feeling was sensed |
|---|---|
| Subject No. 1 | 4.0 |
| Subject No. 2 | 4.0 |
| Subject No. 3 | 5.0 |
| Subject No. 4 | 3.0 |
| Subject No. 5 | 5.0 |
| Subject No. 6 | 4.0 |
| Subject No. 7 | 4.0 |

As shown in Table 1, 5 out of 7 golfers had a voluminous feeling for the badge member of sample 4 whose ratio V/S is 4.0, and all of the 7 golfers had a voluminous feeling for the badge member of sample 5 whose ratio V/S is 5.0. From the present experiment, the inventors of the present invention have realized that an iron golf club head may offer a satisfactory voluminous feeling to the golfers if the ratio V/S of the iron golf club head 100 is 4.0 or more.

<Experiment 2: Voluminous feeling of a conventional badge member and the Badge Member of the Present Invention>

In this experiment, the ratio V/S for the iron golf club heads of samples 7 to 10 manufactured and sold by the applicant of the present invention was evaluated. Furthermore, the iron golf club head 100 according to the present embodiment illustrated in FIGS. 1 to 12 was evaluated as the iron golf club head of sample 11 for the ratio V/S. The evaluation results are shown in Table 2. The iron golf club head of sample 11 was designed to have the following dimensions: the distance W4 is 64.8 mm, the width W5 is 3 mm, the distance W6 is 2 mm, the maximum width W7 is 13.5 mm, and the maximum depth D1 is 6.3 mm. The second bottom surface of the badge member was recessed 0.5 mm relative to the second top surface. In a planar view of the opposed surface, the ratio of the area occupied by the plurality of recesses to the total area surrounded by the outline of the badge member is approximately 30%. The minimum distances L1, L2, L3, L4 and L5 were 2.3 mm, 3.0 mm, 5.2 mm, 4.7 mm and 3.3 mm, respectively.

TABLE 2

| | Volume V ($mm^3$) | Area S ($mm^2$) | Ratio V/S |
|---|---|---|---|
| Sample 7 | 2448 | 923 | 2.65 |
| Sample 8 | 2819 | 1149 | 2.45 |
| Sample 9 | 3445 | 991 | 3.48 |
| Sample 10 | 2754 | 1288 | 2.14 |
| Sample 11 | 4476 | 776 | 5.77 |

As shown in Table 2, it was confirmed the ratio V/S for each iron golf club head from sample 7 to sample 10 was less than 3.5, and none of them was 4.0 or more.

On the other hand, it was confirmed that the ratio V/S for the iron golf club head of sample 11 was 5.77. In other words, the iron golf club head 100 according to the present embodiment can offer a satisfactory voluminous feeling to the golfers.

<Experiment 3: Bendability of the Badge Member>

In this experiment, the bendability of the badge member was evaluated via computer simulation. Specifically, the badge member 2 according to the present embodiment was evaluated as the badge member of sample 12 for the bendability. In other words, the badge member of sample 12 is equivalent to the badge member of sample 11. Furthermore, the badge member of sample 13 has the same ratio V/S as the badge member of sample 12 but is provided with no recess. As described above, the ratio V/S for each of sample 12 and sample 13 was 5.77. The material constituting the metal plate of samples 12 and 13 was Ni, and the material constituting the resin plate was TPU.

In the evaluation test via computer simulation, a three-point bending test was performed on the badge member. Specifically, first, a heel-side belt region that is distant from the heel by a distance of 20 mm and has a width of 1 mm and a toe-side belt region that is distant from the toe by a distance of 20 mm and has a width of 1 mm were constrained relative to a central belt region that is located at a central position in the toe-to-heel direction of the badge member, extends from the upper edge to the lower edge and has a width of 1 mm. Next, a total load of 30 N was uniformly applied to the central belt region from the side of the opposed surface, and the maximum displacement at this time was evaluated.

According to the evaluation result, the maximum displacement of sample 13 was 0.02 mm. In sample 13, the portion bent by 0.02 mm was limited to such a portion in the central belt region that is located closer to the upper edge and is relatively thin. In particular, in sample 13, the displacement of such a portion in the central belt region that is located closer to the lower edge, relatively thick and is provided with no recess was less than 0.01 mm.

On the other hand, the maximum displacement of sample 12 was 0.03 mm. In addition, compared with the portion bent by 0.02 mm in sample 13, the portion bent by 0.03 mm in sample 12 spread in both the first portion that is relatively thin and the second portion that is relatively thick in the toe-to-heel direction and the vertical direction. In sample 12, the displacement of a portion in the central belt region that is located closer to the lower edge and is relatively thick was 0.015 mm or more. It was confirmed that by providing a plurality of recesses on the second portion which is relatively thick in the badge member, it is possible to make sample 12 bend easily than sample 13 that is provided with no recess.

<Experiment 4: Detachment of the Badge Member>

Figure 15:
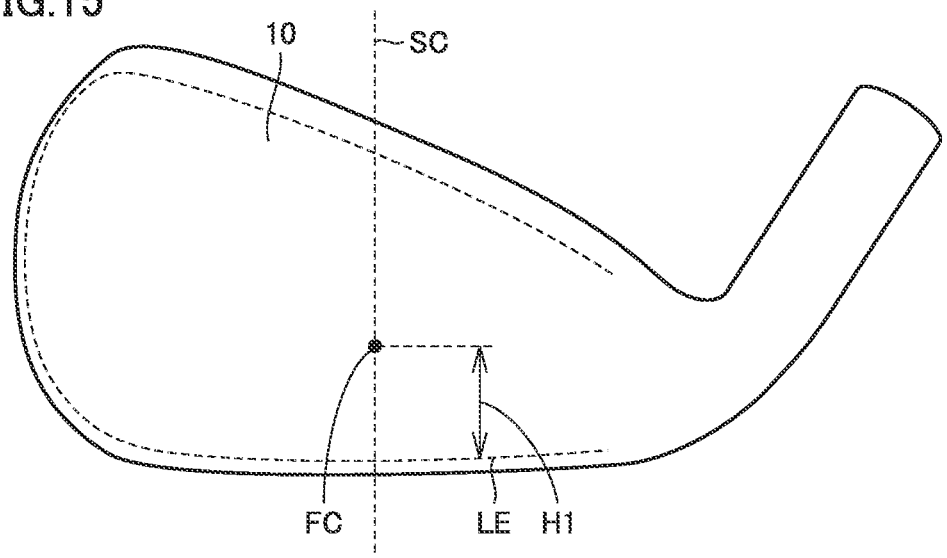
FIG. 15 is a view for explaining a face center FC of the iron golf club head.

In this experiment, the detachment of the badge member was evaluated for sample 11. Specifically, after 3000 times of ball-hitting with the face center of sample 11 at normal temperature (23° C.), whether or not the badge member detached from the head member was evaluated. The head speed right before hitting a ball was 39 m/s With reference to FIG. 15, the face center FC lies at the score centerline SC of the iron golf club head with a distance of 15 mm from the leading edge LE toward the top edge. Further, the material of the head member was chromium molybdenum steel, the material of the metal plate was Ni, and the material of the resin plate was TPU. A double-sided adhesive tape was used as the adhesive member.

According to the evaluation result, the badge member did not detach from the head member even after 3000 times of ball-hitting. Thus, it was confirmed that if the ratio V/S of an iron golf club head is equal to or more than that of sample 11 that is 4.0 or more, it is difficult for the badge member to detach therefrom. On the other hand, even though the ratio V/S of an iron golf club head is greater than that of sample 11 but equal to or less than 10.0, by appropriately providing a plurality of recesses on the iron golf club head, it is possible to obtain the maximum displacement equivalent to sample 12 in Experiment 3 mentioned above. Thereby, the detachment of the badge member from the iron golf club head is equivalent to that of sample 11.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An iron golf club head comprising:

a head member having a hitting surface and a back surface located opposite to the hitting surface; and a badge member having an opposed surface facing the back surface and connected to the back surface, and an exposed surface located opposite to the opposed surface and exposed to the outside, the badge member including a resin plate having the opposed surface and made of a resin material, and a metal plate having the exposed surface and made of a metal material, the resin plate being provided with a plurality of recesses recessed toward the opposed surface, the plurality of recesses being arranged side by side in a first direction from a heel of the iron golf club head to a toe thereof, the width of each of the plurality of recesses in the first direction being smaller than the width of each of the plurality of recesses in a second direction from a top edge of the iron golf club head to a leading edge thereof, and a ratio V/S of a volume V (unit: $mm^3$) of the badge member to an area S (unit: $mm^2$) of the opposed surface being 4.0 or more and 10.0 or less.

2. The iron golf club head according to claim 1, wherein the badge member has a first portion located closer to the top edge and a second portion located closer to the leading edge than the first portion in the second direction, and the thickness of the first portion is smaller than the thickness of the second portion.

3. The iron golf club head according to claim 1, wherein the head member includes a thick portion provided at a substantially central position in the first direction, a thin portion provided around the thick portion, and a taper portion provided between the thick portion and the thin portion, the back surface includes a first top surface included in the thick portion, a first bottom surface included in the thin portion, and a first inclined surface included in the taper portion and inclined relative to the first top surface and the first bottom surface, and the opposed surface includes a second bottom surface located opposite to the first top surface, a second top surface located opposite to the first bottom surface, and a second inclined surface located opposite to the first inclined surface and inclined relative to the second top surface and the second bottom surface.

4. The iron golf club head according to claim 1, wherein the coefficient of restitution of the head member is 0.82 or more.

5. The iron golf club head according to claim 2, wherein the head member includes a thick portion provided at a substantially central position in the first direction, a thin portion provided around the thick portion, and a taper portion provided between the thick portion and the thin portion, the back surface includes a first top surface included in the thick portion, a first bottom surface included in the thin portion, and a first inclined surface included in the taper portion and inclined relative to the first top surface and the first bottom surface, and the opposed surface includes a second bottom surface located opposite to the first top surface, a second top surface located opposite to the first bottom surface, and a second inclined surface located opposite to the first inclined surface and inclined relative to the second top surface and the second bottom surface.

6. The iron golf club head according to claim 2, wherein the coefficient of restitution of the head member is 0.82 or more.

7. The iron golf club head according to claim 5, wherein the coefficient of restitution of the head member is 0.82 or more.

* * * * *